United States Patent [19]

Meier et al.

[11] Patent Number: 4,667,610

[45] Date of Patent: May 26, 1987

[54] DEVICE FOR VARYING THE HEIGHT OF A BED IN A FLUIDIZED COMBUSTION CHAMBER

[75] Inventors: Hans-Joachim Meier; Aruth Rafael, both of Wesel, Fed. Rep. of Germany

[73] Assignee: Deutsche Babcock Werke Aktiengesellschaft, Oberhausen, Fed. Rep. of Germany

[21] Appl. No.: 860,586

[22] Filed: May 7, 1986

[30] Foreign Application Priority Data

Jun. 22, 1985 [DE] Fed. Rep. of Germany ..... 3522394

[51] Int. Cl.[4] ..... F23G 5/00

[52] U.S. Cl. ..... 110/245; 431/7; 431/170; 432/15; 432/58

[58] Field of Search ..... 431/7, 170; 110/245, 110/263, 101 CC, 346, 705; 122/4 D; 432/14, 15, 58; 165/104.16

[56] References Cited

U.S. PATENT DOCUMENTS

| | | | |
|---|---|---|---|
| 4,279,205 | 7/1981 | Perkins et al. | 110/245 |
| 4,419,965 | 12/1983 | Garcia-Mallol et al. | 122/4 D |
| 4,488,512 | 12/1984 | Boyle | 122/4 D |
| 4,530,207 | 7/1985 | Brännström | 110/263 X |
| 4,584,949 | 4/1986 | Brännström | 431/170 X |

*Primary Examiner*—Margaret A. Focarino
*Attorney, Agent, or Firm*—Max Fogiel

[57] ABSTRACT

A device for varying the height of a bed in a fluidized combustion chamber inside a pressurized housing. Bed material is supplied to the chamber from hoppers or returned back to the hoppers from the chamber through a supply line. The supply line connects the chamber and the hoppers. The hoppers have means of increasing or decreasing the pressure. To improve the means of both increasing and decreasing pressure in the known device and of cleaning the gas that enters into contact with the material in the hopper, each hopper contains a hot-gas filter that gas can flow through in two directions and each hopper communicates above the filter with a gas connection that can be maintained at either a higher or a lower pressure than the fluidized combustion chamber.

8 Claims, 3 Drawing Figures

DEVICE FOR VARYING THE HEIGHT OF A BED IN A FLUIDIZED COMBUSTION CHAMBER

BACKGROUND OF THE INVENTION

The present invention relates to a device for varying the height of a bed in a fluidized combustion chamber inside a pressurized housing by supplying bed material to the chamber from hoppers or by returning the bed material back to the hoppers from the chamber through a supply line that connects the chamber and the hoppers, which have means of increasing or decreasing the pressure.

The fluidized combustion chamber in a device of this type that is known from EP OS No. 0 124 842 communicates with a hopper through two lines. The out-thrust line communicates with the hopper through a cyclone precipitator and is maintained at low pressure. Another line that is maintained at low pressure opens into a separate return line. Both pressurized lines have valves. Thus, the known device for varying the height of bed is expensive.

SUMMARY OF THE INVENTION

The object of the present invention is to improve the means of both increasing and decreasing pressure in the known device and of cleaning the gas that enters into contact with the material in the hopper. This object is attained in accordance with the invention in a device of the type initially described wherein each hopper contains a hot-gas filter that gas can flow through in two directions and each hopper communicates above the filter with a gas connection that can be maintained at either a higher or a lower pressure than the fluidized combustion chamber.

The gas connection can communicate with a preheater in an empty space inside the fluidized combustion chamber that heats the medium flowing through it to the temperature that prevails inside the hopper.

One section of the supply line in this embodiment can slope up at an angle of 10° to 30° to the horizontal upstream of where it opens into the fluidized combustion chamber.

The hot-gas filter in this embodiment of the invention can be made out of a ceramic material.

In another embodiment of the invention, with a fluidized combustion chamber with walls that converge to some extent, the hoppers can be positioned directly at the converging section of the fluidized combustion chamber and can communicate with it through a siphon-type slot and the hoppers have an air box with a floor that is equipped with nozzles.

This embodiment can have a distributor in the vicinity of the siphon-type slot and supplied with air.

Feed water or steam can flow through the walls of the hoppers in any of these embodiments.

The device in accordance with the invention is essentially simple. It employs only a single supply line and a single pressure-supply line, which can be maintained at different pressures. Furthermore, the hot-gas filter is integrated into the hopper. When the pressure in the hopper is decreased, the gas flows through the filter in the opposite direction and is cleaned. Employing a ceramic material for the hot-gas filter provides a simple means of thoroughly cleaning the gas.

Some preferred embodiments of the invention will now be described with reference to the attached drawings, wherein

DESCRIPTION OF THE PREFERRED EMBODIMENTS

Figure 1:
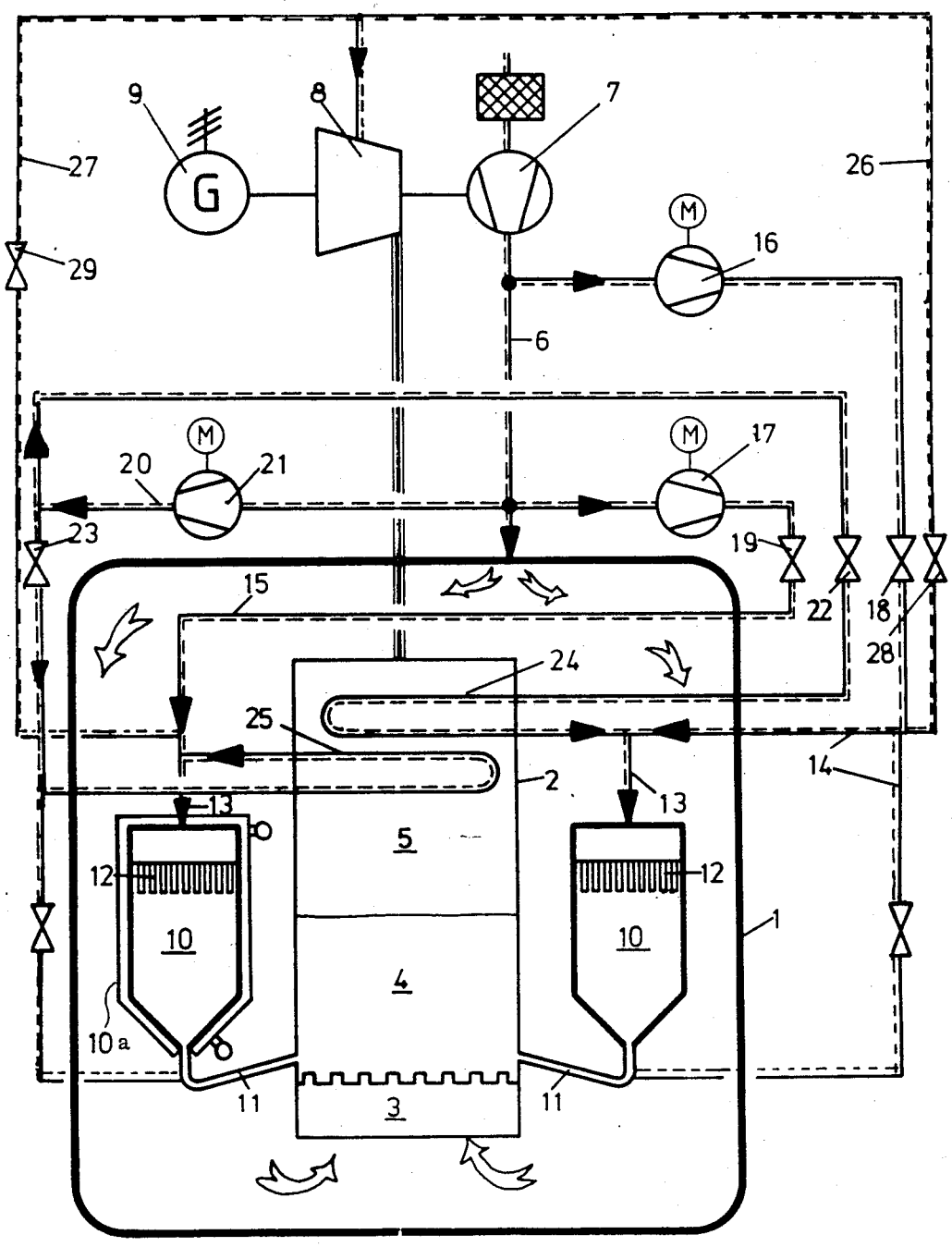
FIG. 1 is a schematic drawing of a fluidized combustion chamber with a device in accordance with the invention.

A fluidized combustion chamber 2 is positioned inside a pressurized housing 1. Fluidized combustion chamber 2 has an air-distribution floor 3. Above floor 3 is a fluidized bed 4. Above bed 4 is an empty space 5. Conveyor pipes inside fluidized bed 4 and empty space 5 generate steam. Since the pipes are not essential to the invention, they are, for simplicity's sake, not illustrated.

An air-supply line 6 opens into pressurized housing 1. A compressor 7 communicates with air-supply line 6 and supplies compressed air to pressurized housing 1. The air penetrates into fluidized bed 4 through the nozzles in air-distribution floor 3 and supplies oxygen to the burning fuel. The resulting hot flue gas is cleaned in unillustrated precipitators and supplied to a gas turbine 8, where it is decompressed. Gas turbine 8 powers compressor 7 and a generator 9.

The height of the material in fluidized bed 4 is varied by means of one or more hoppers 10, heat-insulated in a practical way, inside pressurized housing 1. The walls 10*a* of hoppers 10 can consist of or be surrounded by pipes with feed water or steam flowing through them.

Each hopper 10 communicates with fluidized combustion chamber 2 through a supply line 11 that opens into the bottom of fluidized bed 4. One section of the supply line slopes up at an angle of 10° to 30° to the horizontal. The sloping section prevents the bed material from overflowing between hoppers 10 and fluidized combustion chamber 2.

There is a hot-gas filter 12 at the top of each hopper 10. Hot-gas filters 12 are made out of a ceramic material and consist of tubes that are open at one end or of a woven or non-woven ceramic fabric that will withstand temperatures of up to approximately 1000°. Above hot-gas filter 12 each hopper 10 has a gas connection 13 that can be employed to vary the pressure inside the hopper. The gas connection 13 and supply line 11 of each hopper 10 communicates with a pressure-supply line 14 or 15 that branches off from the line 6 that supplies air to pressurized housing 1 from compressor 7. A pressure-augmentation blower 16 or 17 and a choke-and-block mechanism 18 or 19 are positioned in each pressure-supply line 14 and 15.

Another pressure-supply line 20, also supplied with a pressure-augmentation blower 21 and choke-and-block mechanisms 22 and 23, can branch off from air-supply line 6. Pressure-supply line 20 communicates with coils 24 and 25 in the empty space 5 inside fluidized combustion chamber 2. Before it enters hopper 10 and travels through hot-gas filter 12, the air is heated in coils 24 and 25 to the temperature that prevails inside hoppers 10 to prevent subjecting the ceramic hot-gas filter 12 to temperature shock.

The gas connection 13 into each hopper 10 also communicates with a decompression line 26 or 27 that contains choke-and-block mechanisms 28 and 29. Decompression line 26 and 27 leads to gas turbine 8 and is connected to the turbine system at a point where its pressure matches that of the decompression line. All choke-and-block mechanisms 18, 19, 22, 23, 28, and 29 are located outside pressurized housing 1.

How the output of fluidized combustion chamber 2 is varied will now be described. To decrease the output, bed material is extracted from fluidized bed 4 and stored in hoppers 10. To increase the output, bed material is returned to fluidized bed 4, increase the height of the bed.

The bed material is extracted by subjecting hoppers 10 with less gas-end pressure through gas connection 13 and decompression line 26 and 27 than what prevails inside fluidized combustion chamber 2. The bed material is accordingly conveyed by means of a pneumatic vacuum into hoppers 10. Due to the insulation of hoppers 10 or due to the medium flowing through their walls, the bed material can be kept hot for a long time and restored hot to fluidized combustion chamber 2 again when needed. The gases that are entrained out of fluidized bed 4 along with the pneumatically conveyed bed material are cleaned in the hot-gas filters 12 integrated into hoppers 10. The clean gas can be reintroduced into the turbine system at an appropriate point.

How hoppers 10 are evacuated into fluidized combustion chamber 2 will now be described. The appropriate choke-and-block mechanisms are thrown and air is blown into hoppers 10 until the pressure is higher than that in fluidized combustion chamber 2. The increased pressure conveys the bed material into fluidized combustion chamber 2 from hoppers 10 through supply lines 11. The conveyance of the material is augmented with air that is blown directly into supply lines 11 through pressure-supply lines 14 and 15. The air flows through hot-gas filter 12 in the opposite direction, simultaneously cleaning it in a very simple way, while hoppers 10 are being evacuated.

Figure 2:
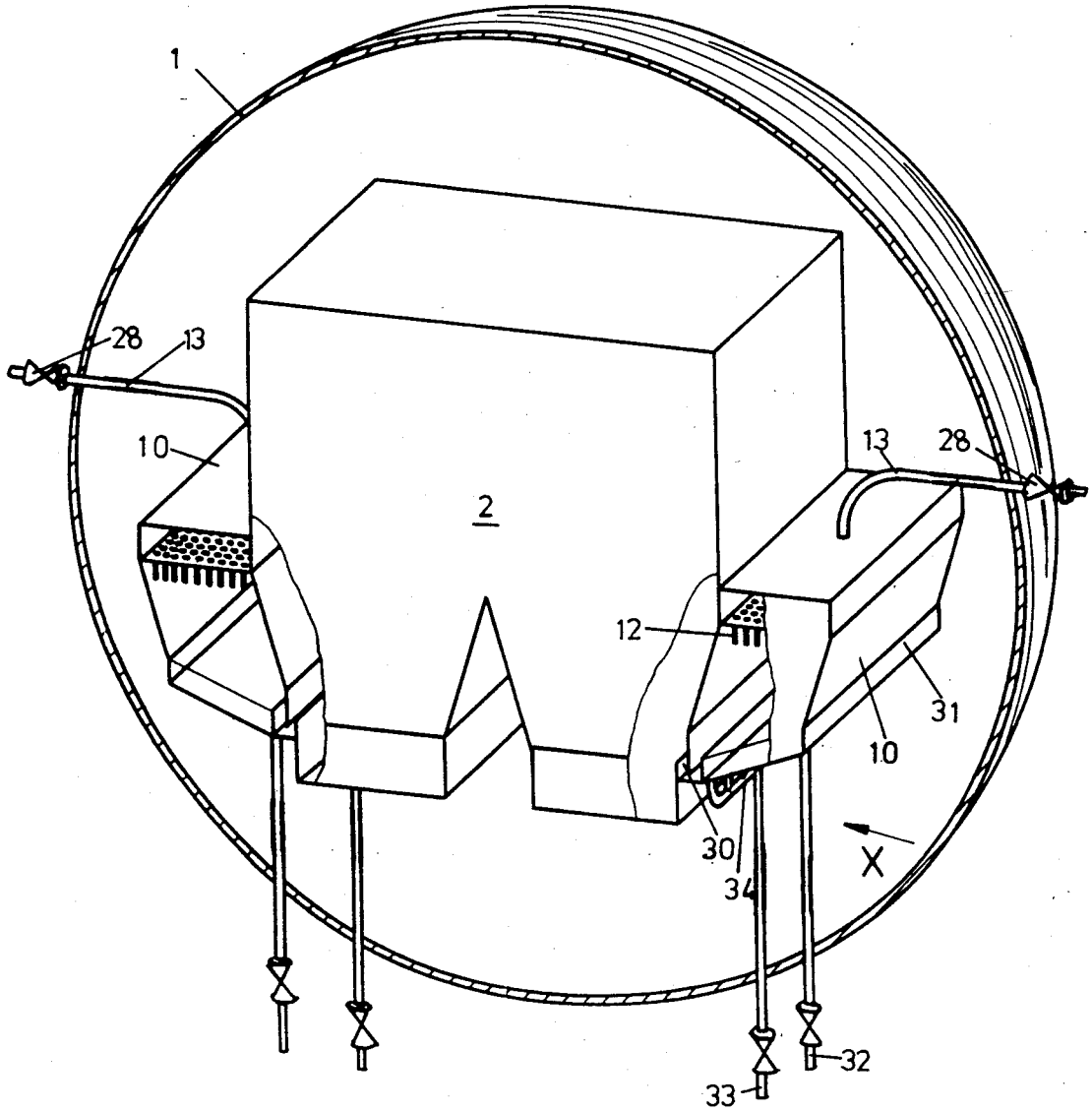
FIG. 2 is a perspective drawing of a fluidized combustion chamber with another embodiment of the invention.
Figure 3:
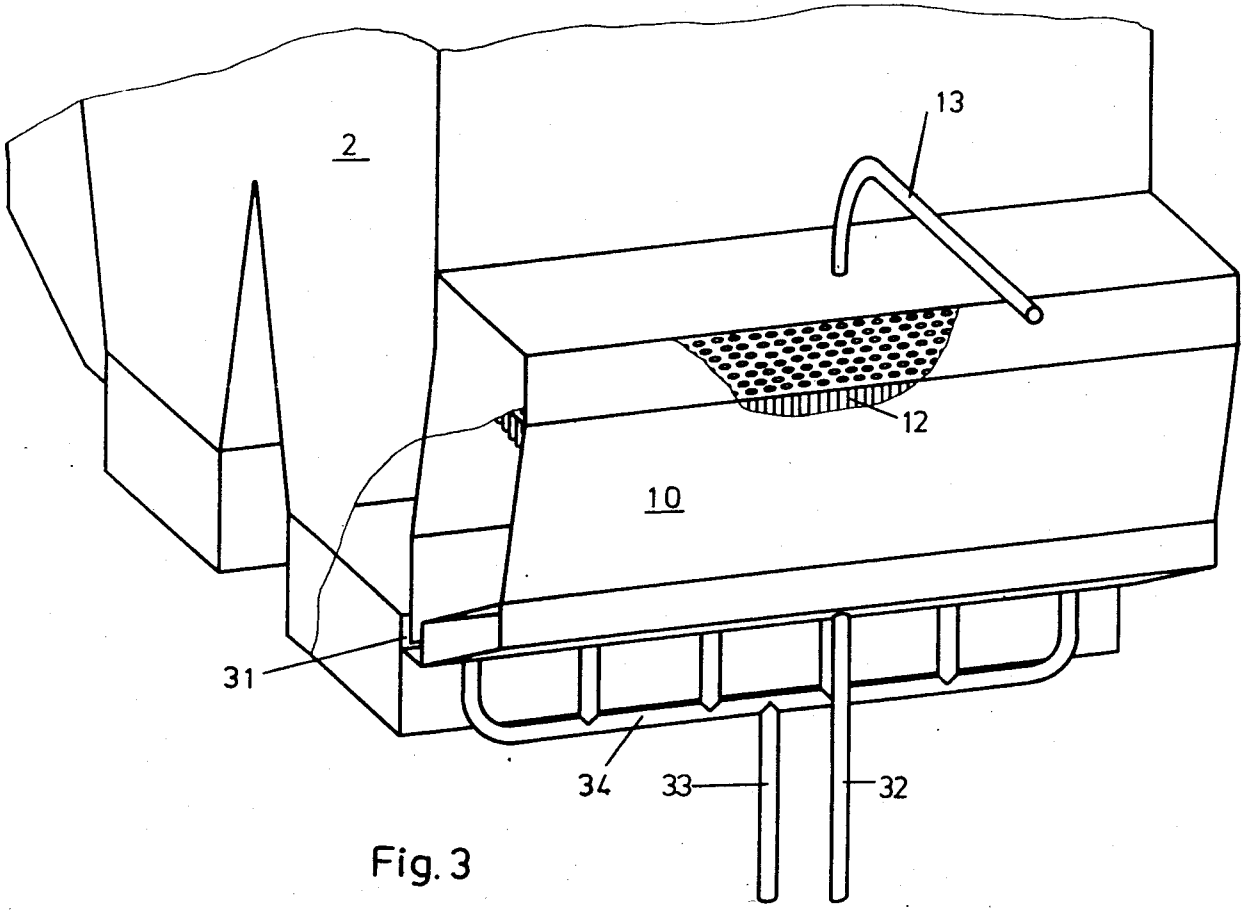
FIG. 3 is a view along the direction indicated by arrow X in FIG. 2.

The walls of the fluidized combustion chamber 2 illustrated in FIGS. 2 and 3 converge to some extent, and hoppers 10 are positioned directly at the converging section.

Hoppers communicate with the fluidized bed 4 in fluidized combustion chamber 2 through a siphon-type slot 30. Slot 30 prevents the bed material from overflowing. Each hopper 10 has an air box (31) that is sealed off from pressurized housing 1 and has a floor that is equipped with nozzles. Air box 31 communicates with an air connection 32 that extends through the wall of pressurized housing 1. Another air connection 33 is provided with a distributor 34 in the vicinity of slot 30. Otherwise, the hoppers 10 illustrated in FIGS. 2 and 3 are identical to those illustrated in FIG. 1.

The loading and unloading of the device illustrated in FIGS. 2 and 3 are activated by fluidizing hopper 10. The fluidizing pressure is higher for evacuation and lower for filling. The fluidizing gases that occur when a hopper 10 is filled are bled through and cleaned by the ceramic hot-gas filter 12 integrated into the hopper.

Air can be supplied to each hopper 10 to clean hot-gas filter 12 during evacuation. The fluidization air that flows into slot 30 through distributor 34 keeps the bed material traveling smoothly at that point.

The invention has been described herein with reference to exemplary embodiments. It will be understood, however, that it is receptable of various modifications, which will offer themselves to those skilled in the art and which are intended to be encompassed within the protection sought for the invention as set forth in the appended claims.

We claim:

1. In an arrangement for varying the height of a bed in a fluidized combustion chamber, comprising: a pressurized housing; hoppers for supplying bed material to said chamber; a single supply line connecting said chamber to said hoppers, said bed material being returned back to said hoppers from said chamber through said supply line; bed material flowing through said single supply line in two opposite directions; said hoppers having means for increasing or decreasing pressure inside said hoppers; a hot-gas filter in each hopper; gas flowing through said gas filter in two opposite directions; gas connection means communicating with each hopper above said filter; said gas connection means being maintainable at a higher or lower pressure than said fluidized combustion chamber; said filter separating solid particles from escaping air upon a pressure decrease in said hopper, a solid particle layer formed on the gas filter surface being blown off when gas flows through the filter in opposite direction for raising pressure in said hopper.

2. An arrangement as deiined in claim 1, including a preheater communicating with said gas connection means in an empty space inside said fluidized combustion chamber, said preheater heating a medium flowing therethrough to a temperature prevailing inside a hopper.

3. An arrangement as defined in claim 1, wherein said supply line has a section sloping up at an angle of 10 to 30 degrees to the horizontal upstream of where said section opens into said chamber.

4. An arrangement as defined in claim 1, wherein said hotgas filter is comprised of ceramic material.

5. An arrangement as defined in claim 1, wherein said fluidized combustion chamber has converging walls, said hoppers being located directly at said converging walls of said chamber; said hoppers communicating with said converging alls through a siphonshaped slot; said hoppers having an air box with a base provided with nozzles.

6. An arrangement as defined in claim 5, including distributing means in vicinity of said siphon-shaped slot and supplied with air.

7. An arrangement as defined in claim 1, wherein said hoppers have walls through which ieed water or steam flows.

8. In an arrangement for varying the height of a bed in a fluidized combustion chamber, comprising: a pressurized housing; hoppers for supplying bed material to said chamber; a single supply line connecting said chamber to said hoppers, said bed material being returned back to said hoppers from said chamber through said supply line; bed material flowing through said single supply line in two opposite directions; said hoppers having means for increasing pressure inside said hoppers; a hot-gas filter in each hopper; gas flowing through said gas filter in two opposite directions; gas connection means communicating with each hopper above said filter; said gas connection means being maintainable at a higher or lower pressure than said fluidized combustion chamber; said filter separating solid particles from escaping air upon a pressure decrease in said hopper, a solid particle layer formed on the gas filter surface being blown off when gas flows through the filter in opposite direction for raising pressure in said hopper; a preheater communicating with said gas connection means in an empty space inside said fluidized combustion chamber, said preheater heating a medium flowing therethrough to a temperature prevailing hopper; said supply line having a section sloping up at an angle of 10 to 30 degrees to the horizontal upstream of where said section opens into said chamber; said hot gas filter comprising ceramic material; said fluidized combustion chamber having converging walls, said hoppers being located directly at said converging walls of said chamber; said hoppers communicating with said converging walls through a siphon-shaped slot; said hoppers having an air box with a base provided with nozzles; distributing means in vicinity of said siphon-shaped slot and supplied with air; said hoppers having walls through which feed water or stream flows.

* * * * *